US011090949B2

(12) United States Patent
Kitaoka et al.

(10) Patent No.: US 11,090,949 B2
(45) Date of Patent: Aug. 17, 2021

(54) DRYER, PRINTER, AND LIQUID APPLICATOR

(71) Applicants: Satoshi Kitaoka, Kanagawa (JP); Toshihiro Yoshinuma, Kanagawa (JP); Ken Onodera, Kanagawa (JP)

(72) Inventors: Satoshi Kitaoka, Kanagawa (JP); Toshihiro Yoshinuma, Kanagawa (JP); Ken Onodera, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/564,407

(22) Filed: Sep. 9, 2019

(65) Prior Publication Data

US 2020/0001622 A1 Jan. 2, 2020

Related U.S. Application Data

(63) Continuation of application No. 15/913,842, filed on Mar. 6, 2018, now Pat. No. 10,434,796.

(30) Foreign Application Priority Data

Mar. 17, 2017 (JP) ..... JP2017-053453
Jan. 30, 2018 (JP) ..... JP2018-013400

(51) Int. Cl.

| | |
|---|---|
| ***F26B 13/08*** | (2006.01) |
| ***B41J 11/00*** | (2006.01) |
| ***B41F 23/04*** | (2006.01) |
| ***F26B 3/04*** | (2006.01) |
| ***F26B 13/18*** | (2006.01) |
| ***F26B 21/02*** | (2006.01) |
| ***F26B 21/10*** | (2006.01) |

(52) U.S. Cl.

CPC ..... *B41J 11/002* (2013.01); *B41F 23/04* (2013.01); *B41F 23/0426* (2013.01); *F26B 3/04* (2013.01); *F26B 13/18* (2013.01); *F26B 21/02* (2013.01); *F26B 21/10* (2013.01); *B41J 11/0045* (2013.01)

(58) Field of Classification Search

CPC ..... D21F 5/042; B41J 11/0015
See application file for complete search history.

(56) References Cited

U.S. PATENT DOCUMENTS 6,105,277 A * 8/2000 Lindberg ..... D21F 5/042 34/116
6,574,884 B1 * 6/2003 Jokinen ..... D21F 5/042 34/114
2009/0295894 A1 * 12/2009 Hori ..... B41J 11/0015 347/102

* cited by examiner

*Primary Examiner* — Lam S Nguyen
(74) *Attorney, Agent, or Firm* — Duft & Bornsen, PC

(57) ABSTRACT

A dryer for conveying and drying an object to be dried, the dryer includes a conveyor including a first path and a second path along which the object to be dried is conveyed, a conveyance direction of the second path being different from a conveyance direction of the first path, and a blower to blow air onto the object to be dried. The blower includes a first air outlet that faces the first path and blows the air onto the object to be dried conveyed along the first path, and a second air outlet that faces the second path and blows the air onto the object to be dried conveyed along the second path.

14 Claims, 7 Drawing Sheets

| ROLLER DIAMETER (mm) | COCKLING HEIGHT (mm) | COCKLING PITCH (mm) | VISUAL INSPECTION |
|---|---|---|---|
| 250 | 0.11 | 5 | COCKLING |
| 200 | 0.06 | 4 | COCKLING |
| 150 | 0.06 | 4.5 | COCKLING |
| 100 | 0.02 | NO PITCH | NO COCKLING |

DRYER, PRINTER, AND LIQUID APPLICATOR

CROSS-REFERENCE TO RELATED APPLICATIONS

This patent application is based on and claims priority pursuant to 35 U.S.C. § 119(a) to Japanese Patent Application No. 2017-053453, filed on Mar. 17, 2017 in the Japan Patent Office and Japanese Patent Application No. 2018-013400, filed on Jan. 30, 2018 in the Japan Patent Office, the entire disclosures of which are hereby incorporated by reference herein. This patent application is a continuation of co-pending U.S. patent application Ser. No. 15/913,842 (filed on Mar. 6, 2018) titled "DRYER, PRINTER, AND LIQUID APPLICATOR," which is hereby incorporated by reference.

BACKGROUND

Technical Field

Aspects of the present disclosure generally relate to a dryer, a printer, and a liquid applicator.

Related Art

A dryer is known that conveys and dries an object to be dried such as a sheet of material onto which a liquid is applied.

Such a dryer includes a heating roller and a plurality of guide rollers. The heating roller conveys a base material (an object to be dried) onto which a liquid is applied along a conveyance path by winding the base material around an outer peripheral surface of the heating roller and rotating while heating the base material. The plurality of guide rollers has a diameter smaller than a diameter of the heating roller. The plurality of guide rollers guides the base material to the heating roller. The dryer includes a blower for blowing air onto the base material wound around the outer peripheral surface of the heating roller.

SUMMARY

In an aspect of this disclosure, an improved dryer for conveying and drying an object to be dried, the dryer includes a conveyor including a first path and a second path along which the object to be dried is conveyed, a conveyance direction of the second path being different from a conveyance direction of the first path. The blower blows air onto the object to be dried. The blower includes a first air outlet that faces the first path and blows the air onto the object to be dried conveyed along the first path, and a second air outlet that faces the second path and blows the air onto the object to be dried conveyed along the second path.

In another aspect of this disclosure, an improved dryer for conveying and drying an object to be dried, the dryer includes a conveyor including a first path and a second path along which the object to be dried is conveyed, the first path facing the second path, and a blower to blow air onto the object to be dried. The blower includes a first air outlet that faces the first path and blows the air onto the object to be dried conveyed along the first path, and a second air outlet that faces the second path and blows the air onto the object to be dried conveyed along the second path.

In still another aspect of this disclosure, a novel printer includes a liquid applier to apply a liquid to the object to be dried, and the dryer as described above.

In still another aspect of this disclosure, a novel liquid applicator for applying a liquid onto an object to be dried, the liquid applicator includes a liquid applier to apply the liquid onto the object to be dried, and a dryer to convey and dry the object to be dried to which the liquid is applied by the liquid applier. The dryer includes a conveyor defining a first path and a second path along which the object to be dried is conveyed, the first path facing the second path, and a blower to blow air onto the object to be dried. The blower includes a first air outlet that faces the first path and blows the air onto the object to be dried conveyed along the first path, and a second air outlet that faces the second path and blows the air onto the object to be dried conveyed along the second path.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
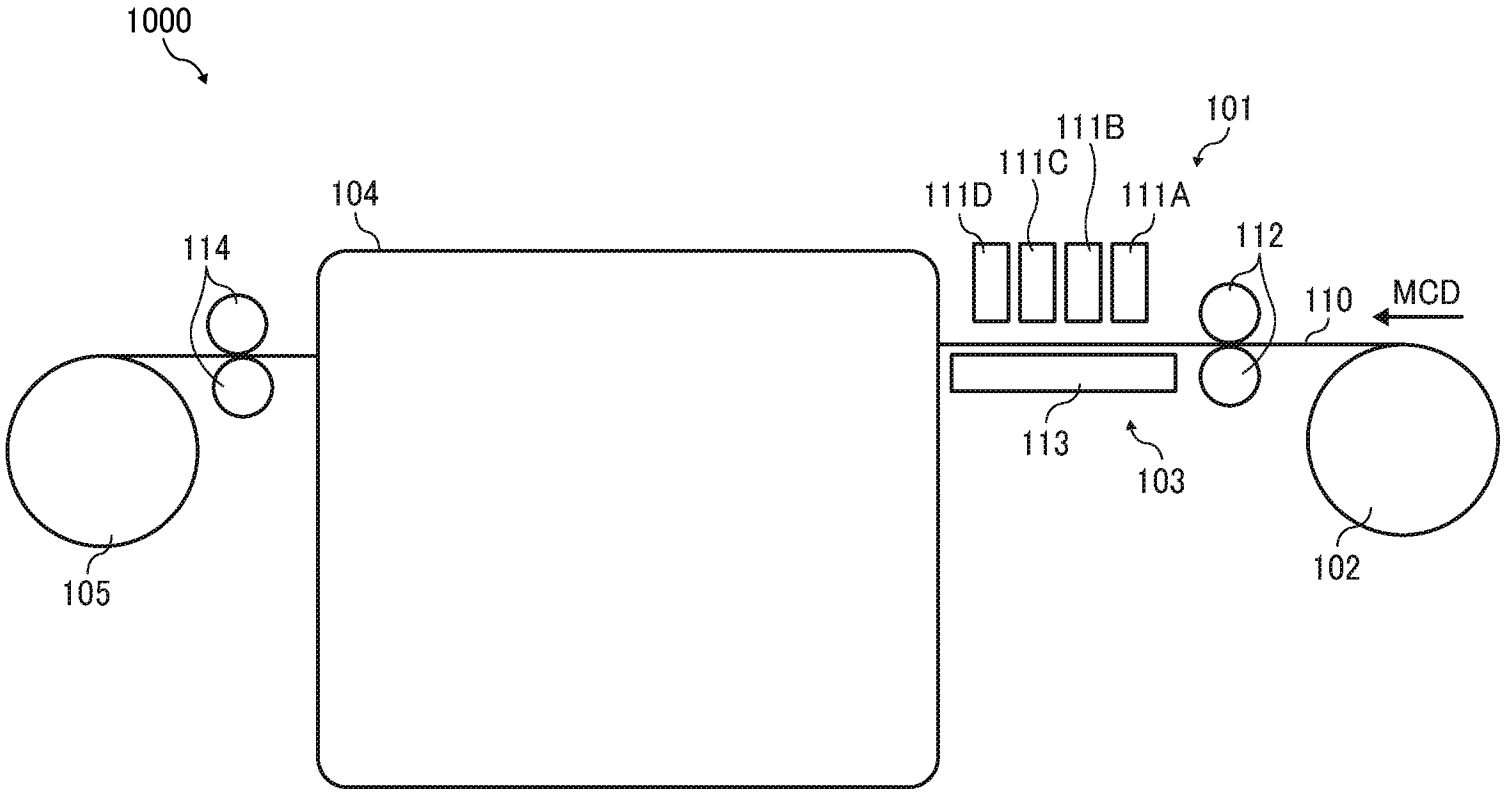
FIG. 1 is a schematic front view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, embodiments of the present disclosure are described below wherein like reference numerals designate identical or corresponding parts throughout the several views.

A printer 1000 according to a first embodiment of the present disclosure is described with reference to FIG. 1. FIG. 1 is a schematic front view of the printer 1000.

The printer 1000 is an inkjet recording apparatus, and includes a liquid applier 101 including a plurality of liquid discharge heads 111A to 111D which is a liquid applicator, to discharge and apply ink onto a continuous sheet 110. The ink is liquid of desired colors. The continuous sheet 110 is a sheet material as a member to be conveyed (object to be dried). Hereinafter, "the liquid discharge head" is simply referred to as the "the head".

The liquid applier 101 includes, for example, full-line heads 111A, 111B, 111C, and 111D (referred to as "heads 111" unless colors distinguished) of four colors are disposed in this order from the upstream side in a medium conveyance direction (MCD) of the continuous sheet 110. The heads 111 respectively applies liquids of black (K), cyan (C), magenta (M), and yellow (Y) onto the continuous sheet 110. Note that the number and types of color are not limited to the above-described four colors of K, C, M, and Y and may be any other suitable number and types.

The continuous sheet 110 fed from a feeding roller 102 is sent to a conveyance guide 113, which is disposed to face the liquid applier 101, by conveyance rollers 112 of a conveyor 103 and is conveyed by being guided by the conveyance guide 113.

The continuous sheet 110 onto which the liquid is applied by the liquid applier 101 is sent by an ejection roller 114 through a dryer 104 as a dryer according to the present embodiment, and is wound around a winding roller 105.

Next, the dryer according to the first embodiment is described with reference to FIGS. 2 and 3.

Figure 2:
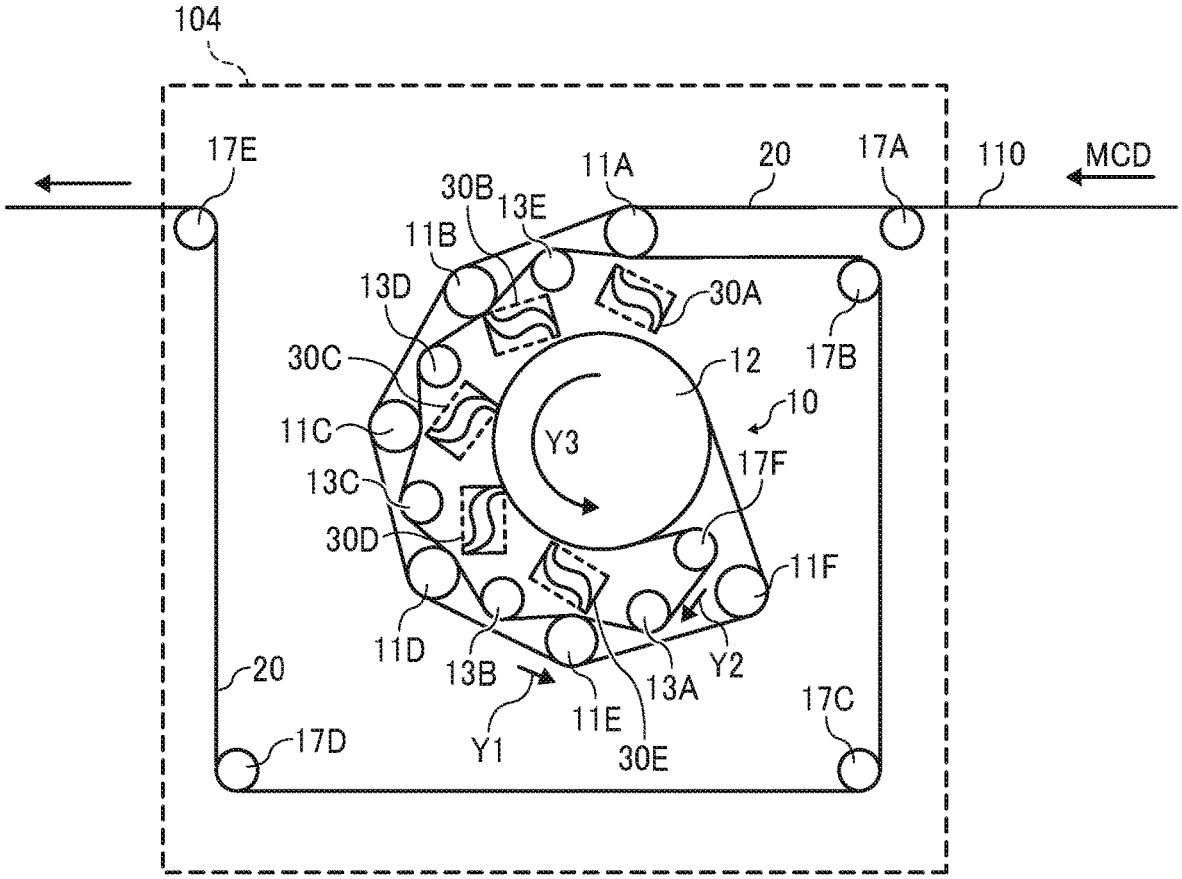
FIG. 2 is an enlarged cross-sectional view of a dryer in the printer according to the first embodiment.

FIG. 2 is an enlarged cross-sectional view of the dryer 104. FIG. 3 is an explanatory cross-sectional view illustrating the contact portion of the continuous sheet 110 with respect to the heating rollers 11.

The dryer 104 includes six heating rollers 11 (11A to 11F) forming a heater 10, a heating drum 12 as a circular heater, and five contact guide rollers 13 (13A to 13E) that guide the continuous sheet 110 to contact the heating rollers 11 (11A to 11F). The dryer 104 includes the guide rollers 17A to 17E to guide the continuous sheet 110 to the heater 10, and the guide roller 17E to wind the continuous sheet 110 around the heating drum 12.

In the present embodiment, the heating drum 12 also serves as a conveyor for providing a conveying force to the continuous sheet 110. The plurality of heating rollers 11A through 11F and the guide rollers 17A through 17F are driven rollers rotated by conveying the continuous sheet 110 while the continuous sheet 110 contacts the plurality of heating rollers 11A through 11F and the guide rollers 17A through 17F.

The heating rollers 11A through 11F are contact heaters whose circumferential surface (contact face 11*a*) in contact with the continuous sheet 110 has a curved surface. Further, the contact guide rollers 13A through 13E guide the continuous sheet 110 to contact the contact face 11*a* of the heating rollers 11A through 11E.

Here, a plurality of heating rollers 11A through 11F (hereinafter, referred to as "heating roller 11" when not distinguished, the same applies to other members) is arranged in an arcuate (curved) shape as illustrated in FIG. 2. Further, the contact guide roller 13 is disposed between adjacent ones of the heating rollers 11.

Here, the heating rollers 11 are disposed equidistantly from the center of the heating drum 12 to the center of each of the heating rollers 11. However, the center of the heating drum 12 is not necessary to be coincident with the center of a curvature of a circular arc of the heating rollers 11, which are disposed in the circular arc arrangement.

The conveyance path (conveying path, conveyance route) 20 of the continuous sheet 110 includes an upstream path Y1, a heating drum path Y3, and a downstream path Y2. Along the upstream path Y1, the continuous sheet 110 is conveyed in a first direction (Y1 direction as illustrated in FIG. 2) while passing through the contact area (heating area) of the plurality of heating rollers 11A through 11F, that is, while contacting the plurality of heating rollers 11A through 11F.

The heating drum path Y3 is a first path in which the continuous sheet 110 is conveyed in a third direction (Y3 direction) along the circumferential surface of the heating drum 12 while wound around substantially the entire circumference of the heating drum 12. The downstream path Y2 is a second path in which the continuous sheet 110 is conveyed in a second direction (Y2 direction) while contacting the plurality of heating rollers 11A through 11F again, to which the continuous sheet 110 contacts at the upstream path Y1.

In the present embodiment, the conveyance path is configured so that the continuous sheet 110 contacts two or more heating rollers 11 (heater) when the continuous sheet 110 is conveyed on the downstream path Y2 (second path).

However, in some embodiments, the conveyance path may be configured on which the continuous sheet 110 contacts a single heating roller 11 (heater) when the continuous sheet 110 is conveyed on the downstream path Y2 (second path). In other words, when the continuous sheet 110 is conveyed on the downstream path Y2 (second path), it is not necessary to contact all of the plurality of heating rollers 11A to 11E again while conveying the continuous sheet 110.

Further, the number of heating rollers 11 that the continuous sheet 110 contacts while passing through the upstream path Y1 and the number of heating rollers 11 that the continuous sheet 110 contacts while passing through the downstream path Y2 are not necessary the same.

Figure 3:
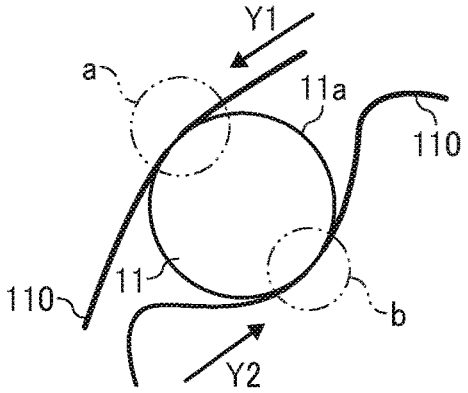
FIG. 3 is a schematic cross-sectional view of a contact portion between the continuous sheet 110 and a heating roller.

In the present embodiment, as illustrated in FIG. 2, the continuous sheet 110 is conveyed while in contact with each outer contact area (circumferential portion "a" on an outer side in a radial curvature direction in FIG. 3) of the plurality of heating rollers 11A to 11F arranged in an arc shape in the upstream path Y1.

Then, the continuous sheet 110 reaches the circumferential face of the heating drum 12 and is wound around and brought into contact with substantially the entire circumference of the heating drum 12, and then is guided again to the heating roller 11E by the guide roller 17F and the contact guide roller 13A via the heating drum path Y3.

Then, the continuous sheet 110 is guided by the contact guide rollers 13A through 13E to an inner contact area (circumferential portion "b" on an inner side in a radial curvature direction in FIG. 3) of the heating rollers 11A through 11E disposed in the circular arc arrangement and is conveyed on the second path Y2, while contacting heating rollers 11A through 11E. The outer contact area "a" is a first heating area, and the inner contact area "b" is a second heating area.

At this time, as illustrated in FIG. 3, the continuous sheet 110 is conveyed on the upstream path Y1 and the downstream path Y2 while simultaneously contacting the two spaced heating areas "a" and "b" (contact areas) of the same heating roller 11. Thus, the first heating area "a" and the second heating area "b" are located in different parts of the heating roller 11 (heater).

In this way, the continuous sheet 110 as the object to be dried is simultaneously passed through two heating areas (contact areas) of the first hating area "a" and the second heating area "b" of the same heater (heating roller 11) and heated by the two heating areas (contact areas) of the same heater (heating roller 11). Accordingly, the dryer 104 can more efficiently dry the object to be dried with a small number of heaters.

Particularly, the dryer 104 of the present embodiment arranges the heaters (heating rollers 11) in an arc shape along the circumferential surface of the heating drum 12. Thus, the present embodiment can reduce the size of the apparatus even if the number of heaters is increased. Thus, the dryer 104 can increase a drying speed by increasing the number of heaters that are brought to bear on the object to be dried.

The dryer 104 in the present embodiment dries the continuous sheet 110 by evaporating (vaporizing) moisture in an ink applied to the continuous sheet 110 to the extent that ink is not transferred to the continuous sheet 110 even if the printed surface of the continuous sheet 110 is directly brought into contact with members of the dryer 104 while the continuous sheet 110 is conveyed along the first path Y1.

Therefore, the dryer 104 of the present embodiment can dispose the contact guide rollers 13 on the printed surface side of the continuous sheet 110 in the second path Y2. Thus, the dryer 104 dries the continuous sheet 110 by conveying the continuous sheet 110 through the downstream path Y2 until the ink on a surface of the continuous sheet 110 is dried to a state such that the dryer 104 can prevent the ink on the front side to be transferred to the back side of the continuous sheet 110 when the continuous sheet 110 is wound around the winding roller 105.

Further, in the dryer 104 of the present embodiment, the heating drum 12 as a circular heater is disposed in the heating drum path Y3. This heating drum 12 has a curved contact area (circumferential surface) that has a curvature smaller than a curvature of a contact surface (contact area) of one of the plurality of the heating rollers 11. Here, the heating drum 12 is driven to rotate, and the heating roller 11 rotates with the continuous sheet 110 to be conveyed. Further, the heating roller 11F, the heating drum 12, and the guide roller 17F form a conveyance path on which the continuous sheet 110 is wound in a region of 70% or more, preferably 80% or more, around the heating drum 12.

At this time, a contact distance of the continuous sheet 110 with respect to the heating drum 12 is longer than a contact distance of the continuous sheet 110 with respect to the heating roller 11. The "contact distance" is a distance in which the continuous sheet 110 contacts a circumferential surface of the heating drum 12 and the heating roller 11 in a direction along a circumferential direction of the heating drum 12 and the heating roller 11 (the medium conveyance direction (MCD)).

Here, the contact distance is a distance in which the continuous sheet 110 is in contact with the curved surface in the direction (conveyance direction) along the circumferential direction of the curved surface when the heater is a curved member including a curved surface as a contact face (contact region) such as the heating roller 11 in the present embodiment.

The contact distance and the winding angle are described with reference to FIGS. 4A and 4B.

Figure 4A:
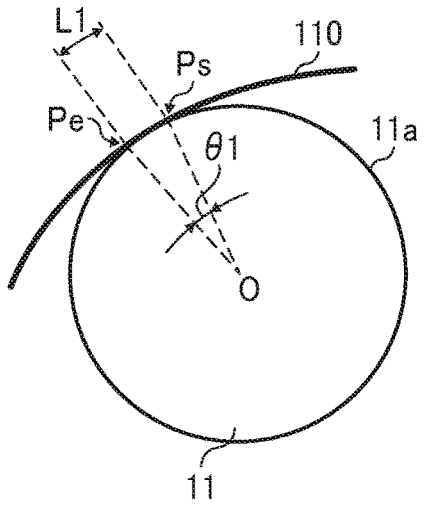
FIGS. 4A and 4B are front views of a heating roller and a heating drum illustrating a winding angle of a continuous sheet to the heating roller and the heating drum.
Figure 4B:
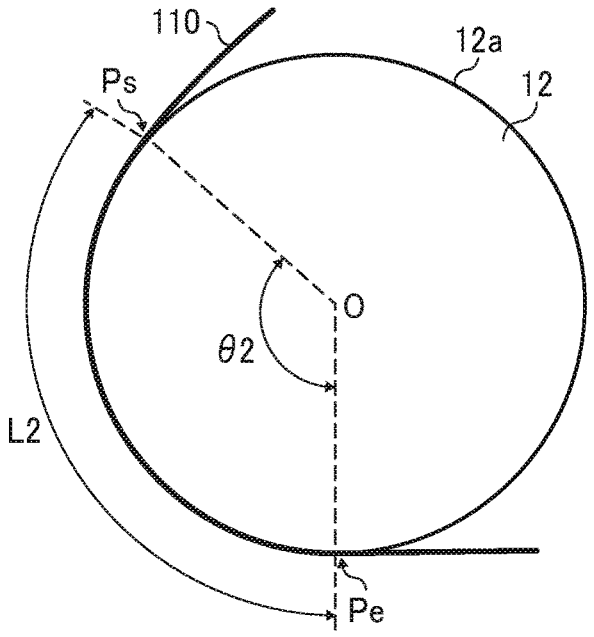

As illustrated in FIGS. 4A and 4B, a conveyance path is configured such that a contact distance L2 between a contact face 12*a* of the heating drum 12 and the continuous sheet 110 is longer than a contact distance L1 between a contact face 11*a* of the heating roller 11 and the continuous sheet 110. Here, a winding angle θ2 of the continuous sheet 110 with respect to the contact face 12*a* of the heating drum 12 is greater than a winding angle θ1 of the continuous sheet 110 with respect to the contact face 11*a* of the heating roller 11 (θ2>θ1).

As illustrated in FIGS. 4A and 4B, the winding angles θ2 and θ1 (collectively referred to as "winding angle θ") indicate angles of a point Ps at which the contact of the continuous sheet 110 with the contact face 12*a* of the heating drum 12 and the contact face 11*a* of the heating roller 11 starts and a point Pe at which the contact of the continuous sheet 110 with the contact face 12*a* of the heating drum 12 and the contact face 11*a* of the heating roller 11 ends, with respect to a center O. Therefore, in a case where the winding angle θ increases, the contact distance also increases insofar as rotary bodies have the same diameter, and even in a case where the winding angles θ are identical to each other, the contact distance increases as the diameter of the rotary body increases.

In the present embodiment, the diameter of the heating drum 12 is greater than the diameter of the heating roller 11, and the winding angle θ2 is greater than the winding angle θ1, and thus, in any case, the contact distance L2 between the contact face 12*a* of the heating drum 12 and the continuous sheet 110 is longer than the contact distance L1 between the contact face 11*a* of the heating roller 11 and the continuous sheet 110.

As described above, even if the winding angles θ are identical to each other, the contact distance increases as the diameter of the rotary body increases. Therefore, by setting the heating drum 12 and the heating roller 11 to have the same diameter and by setting the winding angle θ2 to be greater than the winding angle θ1, the contact distance L2 between the contact face 12*a* of the heating drum 12 and the continuous sheet 110 becomes longer than the contact distance L1 between the contact face 11*a* of the heating roller 11 and the continuous sheet 110.

As a result, it is possible to heat and dry the continuous sheet 110 that is heated by the heating roller 11 on the upstream path Y1 by further applying a large amount of heat using the heating drum 12 on the heating drum path Y3.

In this case, the continuous sheet 110 immediately after the application of liquid is conveyed on the upstream path Y1 while contacting the heating roller 11, thus reducing the cockling.

Since the continuous sheet 110 is wound around the heating drum 12 in the heating drum path Y3, the dryer 104 can efficiently dry the continuous sheet 110 while bringing the continuous sheet 110 into close contact with the circumferential face of the heating drum 12.

For example, in an initial state in which time has not elapsed from the moment of liquid application, the strength of the continuous sheet 110 decreases. Accordingly, it may be difficult to bring a rear surface the continuous sheet 110 closely into contact with a circumferential surface (a contact face) of the rotary body in a wide range (a long contact distance). Hence, in an initial state where the applied liquid is not dried, the winding angle θ of the continuous sheet 110 with respect to the heating roller 11 is set to be small, and thus, the contact distance is shortened. By increasing the curvature of the heating roller 11, a tensile force generated at the time of conveying the continuous sheet 110 is changed to a pressing force on a contact portion of the continuous sheet 110 with the heating roller 11. Thus, a contact state of the continuous sheet 110 with the heating roller 11 becomes even. In this state, cockling or wrinkling of the continuous sheet 110 is suppressed or corrected, and when passing through the plurality of heating rollers 11, there is a state in which it is possible to uniformly perform the heat supply required for evenly drying the liquid on the continuous sheet 110.

Even if the contact distance between the continuous sheet 110 and the heating drum 12 increases, the continuous sheet 110 in which the cockling is reduced and the drying proceeds can be brought into close contact with the contact face 12*a* (curved surface) of the heating drum 12. Therefore, a large amount of heat can be supplied to the continuous sheet 110 to efficiently dry the continuous sheet 110 in a short time on the heating drum 12 disposed downstream from the plurality of heating rollers 11 by increasing the contact distance L2 of the continuous sheet 110.

Further, in the present embodiment, the back side of the continuous sheet 110 is brought into contact with the heating roller 11 again at the downstream path Y2 disposed in a downstream of the heating drum path Y3. Therefore, for example, the dryer 104 can fix the ink to the continuous sheet 110 by evaporating the moisture in the ink with heat transferred from the heating roller 11 in the upstream path Y1 and heat transferred from the heating drum 12 in the heating drum path Y3 and then by evaporating solvent in the ink with heat transferred from the heating roller 11 in the downstream path Y2.

Next, an example of a relation between the roller diameter of the heating roller 11 and the cockling of the continuous sheet 110 is described with reference to FIG. 5.

Figures 5, 6:
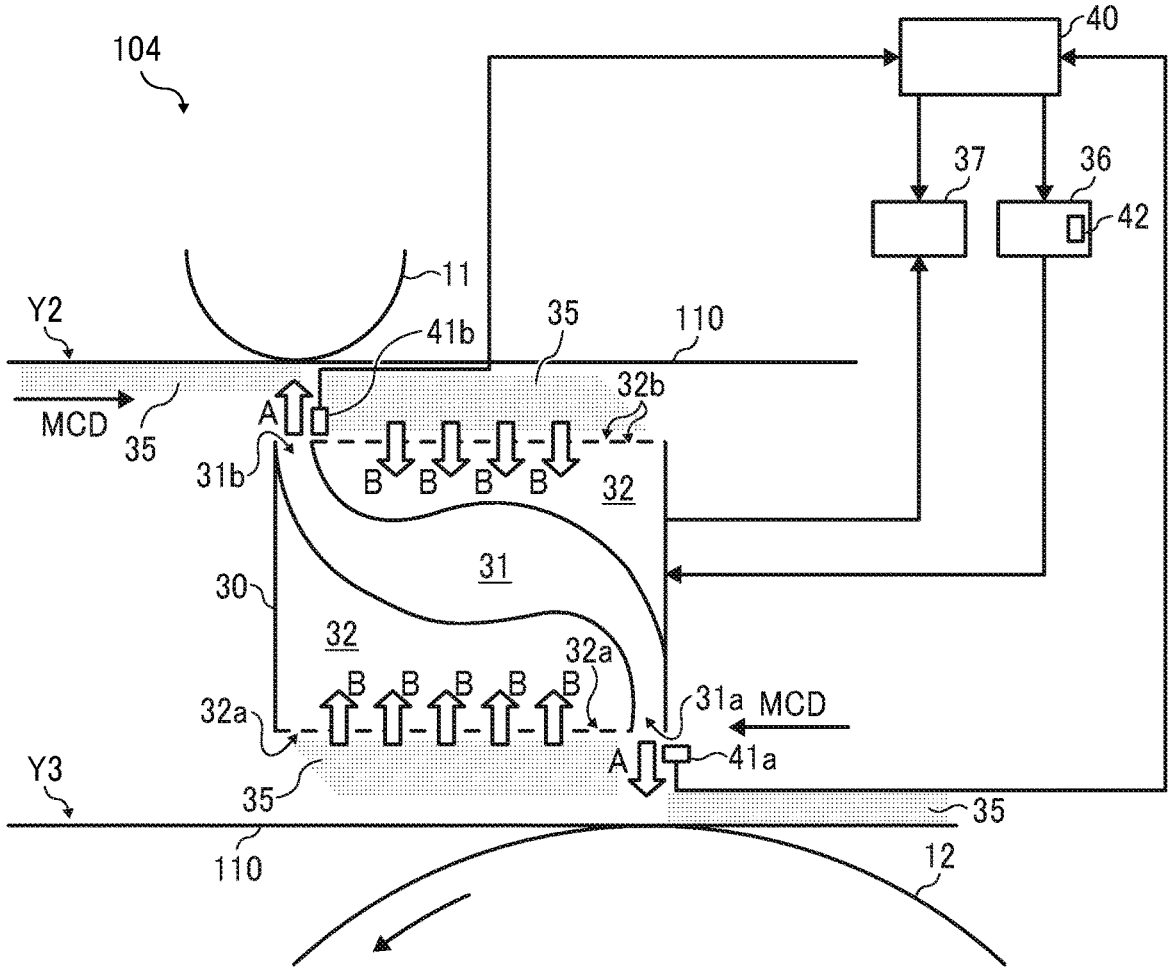
FIG. 5 is a table of measurements of a height of cockling and a pitch of cockling occurring in the continuous sheet while changing a diameter of the heating roller.
FIG. 6 is a schematic cross-sectional view of the dryer according to a first embodiment of the present disclosure.

FIG. 5 is a table of results of measuring a height of cockling and a pitch of cockling occurring in the continuous sheet 110 while changing the diameter of the heating roller 11. FIG. 5 further illustrates a presence or an absence of visually observable cockling checked while changing the diameter of the heating roller 11.

From this result, in this example, it is known that the cockling height is almost halved compared with a case where the diameter of the heating roller 11 is 250 mm, by setting the diameter of the heating roller 11 to 200 mm, and the cockling disappears by setting the diameter of the heating roller 11 to be 100 mm or less. Therefore, the diameter of the heating roller 11 is preferably 200 mm or less, more preferably 100 mm or less.

Next, a supply and exhaust device provided in the dryer 104 according to the present embodiment is be described.

As illustrated in FIG. 2, the dryer 104 of the present embodiment includes six heating rollers 11A to 11F and five supply and exhaust device 30A to 30E. The heating rollers 11A to 11F are arranged in an arc shape along the circumferential surface of the heating drum 12.

The supply and exhaust devices 30A to 30E constitute a part of a blower arranged in a space between the heating drum 12 and the contact guide rollers 13A to 13J. The supply and exhaust device 30 blows air toward both of the continuous sheet 110 passing through the heating drum path Y3 and the continuous sheet 110 passing through the downstream path Y2.

The dryer 104 using air blown from the supply and exhaust device 30 can dry the continuous sheet 110 in a shorter time than drying only by the heat transferred from the heating roller 11 and the heating drum 12.

Further, moisture vaporized in the conveyance path or solvent concentration is high in the dryer 104 of the present embodiment since the continuous sheet 110 is conveyed within a limited area in the apparatus by bending or folding the conveyance path of the continuous sheet 110. As a result, the moisture or solvent that is once vaporized may re-adhere to the continuous sheet 110 and lower the drying efficiency of the dryer 104.

Therefore, the supply and exhaust device 30 of the present embodiment also functions as a collector for collecting (exhausting) air removed from the vicinity of the continuous sheet 110 by blowing air onto the continuous sheet 110. This air contains a gas containing vaporized moisture and a liquid component such as a solvent. Thus, the present embodiment can prevent the vaporized moisture and solvent from re-adhering to the continuous sheet 110 to improve the drying efficiency.

Particularly, air containing moisture and solvent vaporized by the heat from both of the heating rollers 11 and the heating drum 12 tends to accumulate in a space between the heating rollers 11 and the circumferential surface of the heating drum 12.

In this way, the dryer 104 of the present embodiment disposes the supply and exhaust device 30 also having a function as a collector in the space where the air containing moisture and solvent easily accumulates. Thus, the dryer 104 of the present embodiment can efficiently exhaust the air containing moisture and solvent and further improve the drying efficiency.

FIG. 6 is a schematic cross-sectional view of the supply and exhaust device 30 according to the present embodiment.

The supply and exhaust device 30 of the present embodiment includes an air duct 31 and a collection duct 32 inside the device. The air duct 31 has two air outlets 31*a* and 31*b*. One of the air outlet 31*a* faces the continuous sheet 110 passing through the heating drum path Y3, and another air outlet 31*b* faces the continuous sheet 110 passing through the downstream path Y2.

The air duct 31 exhausts the air supplied from an airflow generator 36 from two air outlets 31*a* and 31*b* as indicated by arrow A. The airflow generator 36 is such as a blowing fan as a part of the blower. The supply and exhaust device 30 simultaneously blows air onto both the continuous sheet 110 passing through the heating drum path Y3 and the continuous sheet 110 passing through the downstream path Y2. This air blow promotes the drying of the continuous sheet 110 and removes the air 35 containing liquid components such as vaporized moisture and solvent from the vicinity of the continuous sheet 110. Thus, the supply and exhaust device 30 can suppress re-adhering of the liquid components on the continuous sheet 110.

The airflow generator 36 of the present embodiment includes a heater 42 to blow hot air from two air outlets 31*a* and 31*b* of the air duct 31. Thus, the dryer 104 can further promotes the drying of the continuous sheet 110.

Preferably, the present embodiment controls the heater 42 with a controller 40 serving as a temperature maintenance device, such that a temperature of the hot air blown out from the two air outlets 31*a* and 31*b* to be equal to or higher than a boiling point of the liquid to be vaporized such as the solvent of the ink.

Specifically, temperature sensors 41*a* and 41*b* are installed on the respective air outlets 31*a* of the air duct 31, and the controller 40 controls the heater 42 so that the temperature of the hot air to be equal to or higher than the boiling point of the liquid to be vaporized based on the detection result read from the temperature sensors 41*a* and 41*b*.

The collection duct 32 of the supply and exhaust device 30 of the present embodiment includes two collection ports 32*a*. One of the collection ports 32*a* face the continuous sheet 110 passing through the heating drum path Y3, and another collection ports 32*b* face the continuous sheet 110 passing through the downstream path Y2.

The collection duct 32 is brought into a negative pressure state by an exhaust device 37 such as an intake fan. The exhaust device 37 causes a suction airflow as indicated by arrow B in FIG. 6 at two of the collection ports 32*a* and 32*b*.

As a result, the air 35 removed from the vicinity of the continuous sheet 110 by the air blown from the air outlets 31*a* of the air duct 31 is collected inside the collection duct 32 from the two collection ports 32*a* and 32*b*.

Thus, the present embodiment can prevent the vaporized moisture and solvent from re-adhering to the continuous sheet 110 to improve the drying efficiency.

The air collected inside the collection duct 32 is exhausted outside the dryer 104. At this time, the supply and exhaust device 30 preferably includes a cooler to cool and condense the collected air and exhausts the air outside the dryer 104 after the liquid component in the collected air is collected.

The space in which the supply and exhaust device 30 of the present embodiment is arranged is narrow. Thus, the air blown from the two air outlets 31*a* and 31*b* of the supply and exhaust device 30 is reflected at the continuous sheet 110 and collides with each other to disturb airflow. The disturbance of the airflow may reduce an effect of supply and collection (exhaustion) of the air by the supply and exhaust device 30.

Thus, in the present embodiment, the continuous sheet 110 conveyed along the heating drum path Y3 and the continuous sheet 110 conveyed along the downstream path Y2 are conveyed in opposite directions as indicated by arrow MCD. The air is blown from the air outlet 31*a* of the supply and exhaust device 30 in the heating drum path Y3, and the air is blown from the air outlet 31*b* of the supply and exhaust device 30 in the downstream path Y2.

Therefore, the airflow is generated such that a direction of the air flows in the vicinity of the continuous sheet 110 in the heating drum path Y3 and a direction of the air current flows in the vicinity of the continuous sheet 110 in the downstream path Y2 are in mutually opposite direction.

As a result, even if the air is simultaneously blown onto the continuous sheet 110 on the heating drum path Y3 and the continuous sheet 110 on the downstream path Y2, the air 35 reflected by the respective continuous sheets 110 flows in the opposite direction by the airflow and do not collide with each other. Therefore, the effect of air supply (exhaustion) does not deteriorate.

Further, as illustrated in FIG. 6, the present embodiment disposes the two collection ports 32*a* and 32*b* of the supply and exhaust device 30 on each of the downstream in the conveyance direction (MCD) of the continuous sheet 110 with respect to the two air outlets 31*a* and 31*b*, respectively.

Therefore, the air 35 blown from the two air outlets 31*a* and 31*b* and reflected at the continuous sheet 110 flows to a portion facing corresponding one of the collection ports 32*a* of the supply and exhaust device 30 by the airflow (airflow flowing in the conveyance direction (MCD)) generated in the vicinity of the continuous sheet 110. Therefore, the supply and exhaust device 30 can efficiently collects the air 35 into the collection duct 32.

A second embodiment according to the present disclosure is described with reference to FIG. 7.

Figure 7:
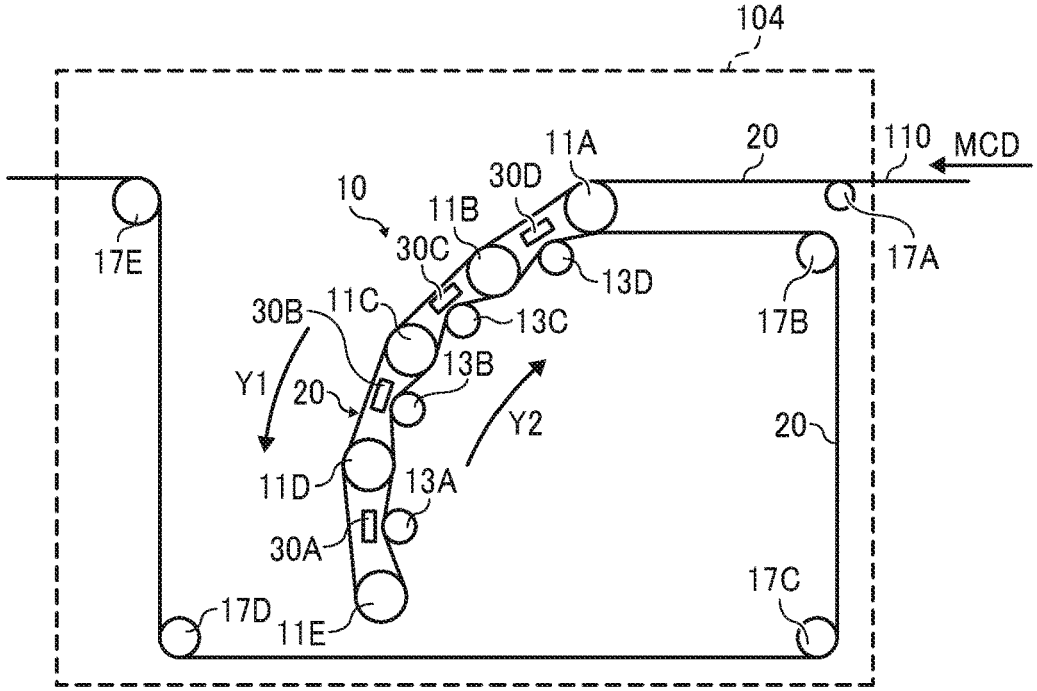
FIG. 7 is a schematic cross-sectional view of a dryer according to a second embodiment of the present disclosure.

FIG. 7 is an enlarged cross-sectional view of a portion of the dryer in the second embodiment. The second embodiment is different from the first embodiment in that the second embodiment does not include the heating drum 12 serving as the circular heater.

The dryer 104 according to the second embodiment includes five heating rollers 11 (11A to 11E) serving as a heater and four contact guide rollers 13 (13A to 13D) that guide the continuous sheet 110 to contact the heating rollers 11 (11A to 11E). In FIG. 7, the heating rollers 11 (11A to 11E) and the contact guide rollers 13 (13A to 13D) constitute a heater 10. The dryer 104 further includes guide rollers 17 (17A to 17E) to guide the continuous sheet 110 to the heater 10.

In the present embodiment, a conveyance path (conveyance route) 20 of the continuous sheet 110 is formed by the plurality of heating rollers 11 and the contact guide rollers 13. The heating rollers 11A to 11E also serves as a conveyer for giving conveyance force to the continuous sheet 110 by the rotation of the heating rollers 11A to 11E.

The conveyance path 20 includes an upstream path Y1 as a first path and a downstream path as a second path. The continuous sheet 110 is conveyed in a first direction (Y1 direction) while contacting the plurality of heating rollers 11A to 11E on the upstream path Y1 (first path).

The continuous sheet 110 is conveyed in a second direction (Y2 direction) while contacting again the plurality of heating rollers 11D to 11A (contacted at the upstream path Y1) on the downstream path (second path). The number of the heating rollers 11 (heaters) constituting each of the upstream path Y1 and the downstream path Y2 is appropriately set in the same manner as in the above-described first embodiment.

In the present embodiment, the continuous sheet 110 is conveyed while in contact with each outer contact areas (circumferential portion "a" on an outer side in a radial curvature direction in FIG. 3) of the plurality of heating rollers 11A to 11E arranged in an arc shape in the upstream path Y1. Then, a direction of conveyance of the continuous sheet 110 is changed at the downstream path Y2.

Then, the continuous sheet 110 is guided by the contact guide rollers 13A to 13D to an inner contact area (circumferential portion "b" on an inner side in a radial curvature direction in FIG. 3) of the heating rollers 11A to 11E disposed in the circular arc and is conveyed on the second path Y2, while contacting the contact guide rollers 13A to 13D and the heating rollers 11A to 11E.

In this way, the dryer 104 of the second embodiment simultaneously heats the continuous sheet 110 at two different heating area (contact area) of the same heating rollers 11A to 11D (heaters). Thus, the dryer 104 of the second embodiment can efficiently dry the continuous sheet 110 (object to be dried) with a small number of heating rollers 11A to 11E (heaters).

As illustrated in FIG. 7, the supply and exhaust devices 30A to 30D as a part of the blower in the present embodiment are disposed one by one in corresponding one of a space between the five heating rollers 11A to 11E arranged in an arc shape.

The supply and exhaust device 30 blows air onto both of the continuous sheet 110 conveyed while contacting the outer contact area of the plurality of heating rollers 11A to 11E and the continuous sheet 110 conveyed while contacting the inner contact areas of the plurality of heating rollers 11A to 11E.

The dryer 104 of the second embodiment can dry the continuous sheet 110 in a shorter time than drying the continuous sheet 110 only by the heat transferred from the heating rollers 11A to 11E by blowing air onto the continuous sheet 110 with the supply and exhaust device 30.

As similar to the first embodiment, the supply and exhaust device 30 of the second embodiment has a function of a collector to collect (exhaust) air (gas containing a liquid component such as vaporized moisture and solvent) removed from the vicinity of the continuous sheet 110 by air blowing.

Thus, the supply and exhaust device 30 according to the present embodiment can prevent the vaporized moisture and solvent from re-adhering to the continuous sheet 110 and improve the drying efficiency.

The dryer 104 of the second embodiment has lesser drying efficiency than the dryer in the first embodiment for the continuous sheet having low air permeability (thick paper, etc.) since the supply and exhaust device 30 blows air onto the back surface of the continuous sheet 110 on the side opposite to the liquid application surface of the continuous sheet 110. However, the dryer of the second embodiment can also achieve sufficient drying efficiency for the continuous sheet 110 (thin paper etc.) having high air permeability.

In the dryer 104 according to the second embodiment, a plurality of heating rollers 11 are arranged in arc (curved) shape. However, a part or whole of the plurality of heating rollers 11 may be arranged linearly. For example, the plurality of heating rollers 11A to 11E may be arranged to have a bending path or a cranked path in the middle of the Y1 direction (or Y2 direction), for example.

A third embodiment according to the present disclosure is described with reference to FIG. 8.

Figure 8:
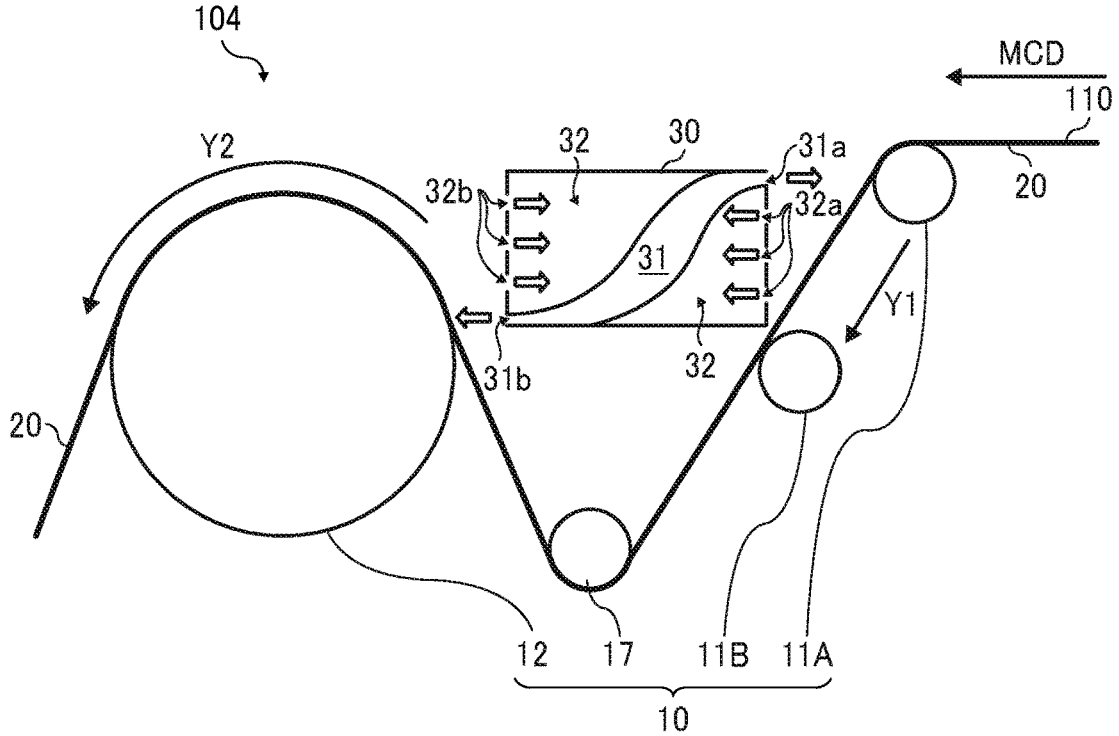
FIG. 8 is a schematic cross-sectional view of a dryer according to a third embodiment of the present disclosure.

FIG. 8 is an enlarged cross-sectional view of a portion of the dryer 104 in the third embodiment. The dryer 104 according to the first embodiment and the second embodiment as described above have a configuration in which the continuous sheet 110 contacts the heating rollers 11A to 11E in the upstream path Y1 and contacts the heating rollers 11A to 11E again in the downstream path Y2. By contrast, the dryer 104 according to the third embodiment has a configuration in which the continuous sheet 110 contacts the heating rollers 11A and 11B in the upstream path Y1 and does not contact the heating rollers 11A and 11B in the downstream path Y2.

The dryer 104 includes two heating rollers 11A and 11B as a heating device, a guide roller 17, and a heating drum 12 as members to configure a heater 10. The guide roller 17 changes a conveyance direction of the continuous sheet 110. In the present embodiment, a conveyance path (conveyance route) 20 of the continuous sheet 110 is formed by the plurality of heating rollers 11A and 11B, the guide roller 17, and the heating drum 12.

The heating drum 12 also serves as a conveyor for providing a conveyance force to the continuous sheet 110. The heating rollers 11A and 11B are driven rollers that are rotated by a conveyance of the continuous sheet 110 conveyed while contacting the heating rollers 11A and 11B.

The conveyance path 20 includes an upstream path Y1 and a downstream path Y2. The continuous sheet 110 is conveyed in a first direction (Y1 direction) while contacting two heating rollers 11A and 11B in the upstream path Y1. The continuous sheet 110, the conveyance direction of which is changed by the guide roller 17, is conveyed in a second direction (Y2 direction) while contacting the heating drum 12 in the downstream path Y2.

A part of the upstream path Y1 and a part of the downstream path Y2 are opposed to (facing) each other. The number of the heating rollers 11 (heating members) constituting the upstream path Y 1 is appropriately set similarly to the first embodiment described above. Instead of the heating drum 12 constituting the downstream path Y2, a plurality of heating members (heating rollers 11) may be used.

In the present embodiment, the continuous sheet 110 is conveyed in contact with the two heating rollers 11A and 11B in the upstream path Y1. Then, the conveyance direction of the continuous sheet 110 is changed from a downward direction to an upward direction by the guide roller 17. The continuous sheet 110 is then conveyed by the heating drum 12 along the downstream path Y2 while contacting the heating drum 12.

As illustrated in FIG. 8, the supply and exhaust device 30 as a part of the blower in the third present embodiment is disposed in a space between the heating rollers 11A and 11B in the upstream path Y1 and the heating drum 12 in the downstream path Y2.

The supply and exhaust device 30 blows air onto both of the continuous sheet 110 conveyed while contacting two heating rollers 11A and 11B and the continuous sheet 110 conveyed while contacting the heating drum 12. The dryer 104 using air blown from the supply and exhaust device 30 can dry the continuous sheet 110 in a shorter time than the drying only by the heat transferred from the heating roller 11 and the heating drum 12.

As similar to the first embodiment, the supply and exhaust device 30 of the second embodiment has a function of a collector to collect (exhaust) air (gas containing a liquid component such as vaporized moisture and solvent) removed from the vicinity of the continuous sheet 110 by air blowing. Thus, the supply and exhaust device 30 according to the present embodiment can prevent the vaporized moisture and solvent from re-adhering to the continuous sheet 110 and improve the drying efficiency.

In the above embodiment, the supply and exhaust device 30 functions as both of the blower and collector. However, the blower and collector may be provided separately.

The above embodiments use a contact heater in which the object to be dried is heated by contacting the heaters as an example. However, the object to be dried may be heated by using a non-contact heater such as a heater that heats the object to be dried by radiant heat or the like.

The above embodiments are described with examples in which the plurality of heating rollers 11 (heating members) and the heating drum 12 (circular heater) are rotary bodies. However, some or all of the heating members and the circular heater need not be rotary bodies.

Further, the dryer 104 of the above embodiments have a configuration in which a plurality of heating rollers 11 (heating members) is arranged in series. However, the dryer 104 may have a simple roller (rotary body) other than the heating member disposed in the middle of the conveyance path.

The above embodiments use both of a drying process using a heat provided from the heating roller 11 (heating member) and the heating drum 12 and a drying process of blowing air from the supply and exhaust device 30. For example, the dryer 104 may perform a drying process that uses a simple roller or drum having no heating function as the heating member (heating roller 11) and the heating drum 12 and uses the supply and exhaust device 30 to blow air onto the continuous sheet 110.

The object to be dried (conveyed member) in the above-described embodiments is the continuous sheet 110 as an example. However, the object to be dried in the present embodiment is not limited to the continuous sheet 110, as long as the object to be dried is an object to be dried by the dryer 104 according to the present disclosure.

For example, a printed object, such as a sheet for an electronic circuit board, for example, wallpaper, prepreg, and the like, may be used in addition to a continuous body, such as a continuous sheet, a roll sheet, and a web, and a recording medium (a printed object) such as an elongated sheet material.

The printer 1000 may record an image such as characters or figures on the object to be dried with a liquid such as ink. The printer 1000 may also record a meaningless image such as a pattern by applying liquid such as ink onto the object to be dried for a decoration purpose.

Further, the second direction is opposite to the first direction in the above-described embodiments as an example. However, the second direction is not limited to the direction opposite the first direction, and may be a direction having an angle with respect to the first direction.

A printer 1010 according to a fourth embodiment of the present disclosure is described with reference to FIG. 9.

Figure 9:
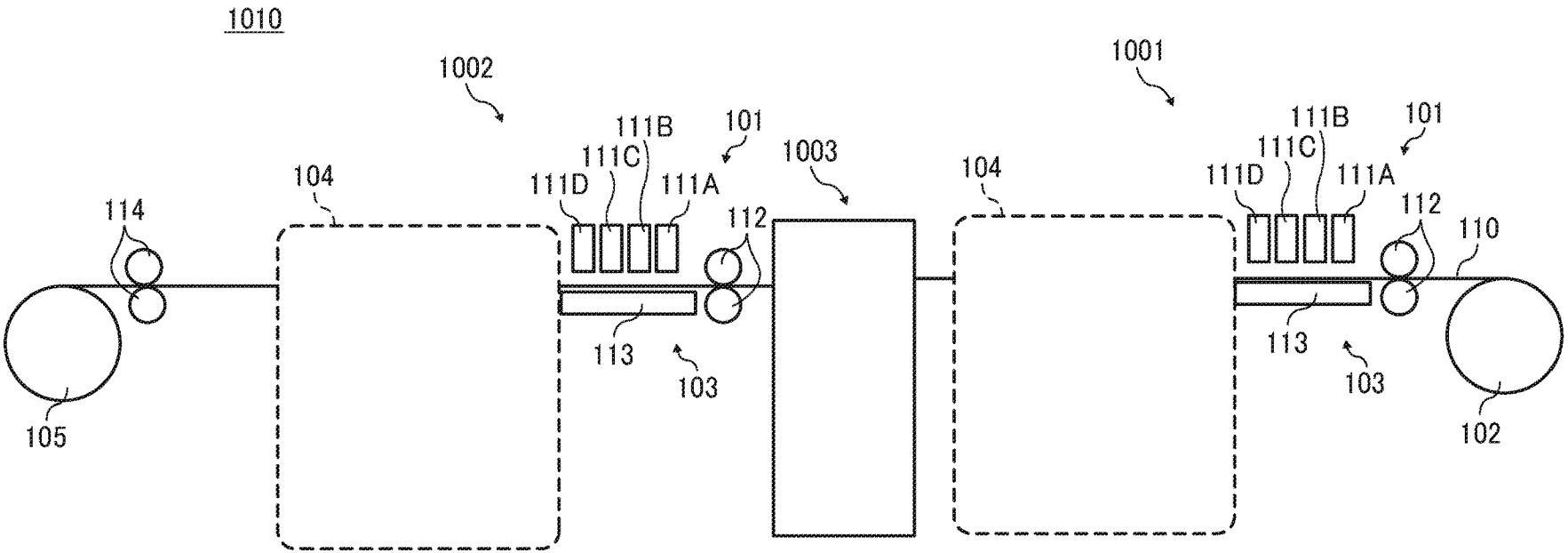
FIG. 9 is a schematic front view of a printer according to a fourth embodiment of the present disclosure.

FIG. 9 is a schematic front view of the printer 1010. The printer 1010 includes a feeding roller 102, a first printer 1001, a reversing unit 1003, a second printer 1002, and a winding roller 105. The first printer 1001, a reversing unit 1003, and a second printer 1002 are disposed between the feeding roller 102 and the winding roller 105. The first printer 1001 performs printing and drying of a first surface of the continuous sheet 110.

The reversing unit 1003 reverses the first surface of the continuous sheet 110, to which image is printed by the first printer 1001, to a second surface of the continuous sheet 110. The second printer 1002 performs printing and drying of the second surface of the continuous sheet 110.

The configuration of the conveyor 103, and the dryer 104 of one of the first, second, and third embodiment may be used for the configurations of the liquid applier 101, the conveyor 103, and the dryer 104 of the first printer 1001 and the second printer 1002. However, other configurations may be used for the liquid applier 101, the conveyor 103, and the dryer 104 of the first printer 1001 and the second printer 1002 of the present embodiment.

Here, the liquid applier 101 of the first printer 1001 is a first liquid applicator to apply the liquid onto the first surface of the continuous sheet 110 that is the object to be dried (member to be conveyed). The liquid applier 101 of the second printer 1002 is a second liquid applicator to apply the liquid onto the second surface opposite the first surface of the continuous sheet 110.

The dryer 104 of the first printer 1001 is a first dryer to which the second surface of the continuous sheet 110 contacts the heating roller 11 in the upstream path Y1. The dryer 104 of the second printer 1002 is a second dryer to which the first surface of the continuous sheet 110 contacts the heating roller 11 in the upstream path Y1.

A treatment liquid applicator 2000 according a fifth embodiment of the present disclosure is described with reference to FIG. 10.

Figure 10:
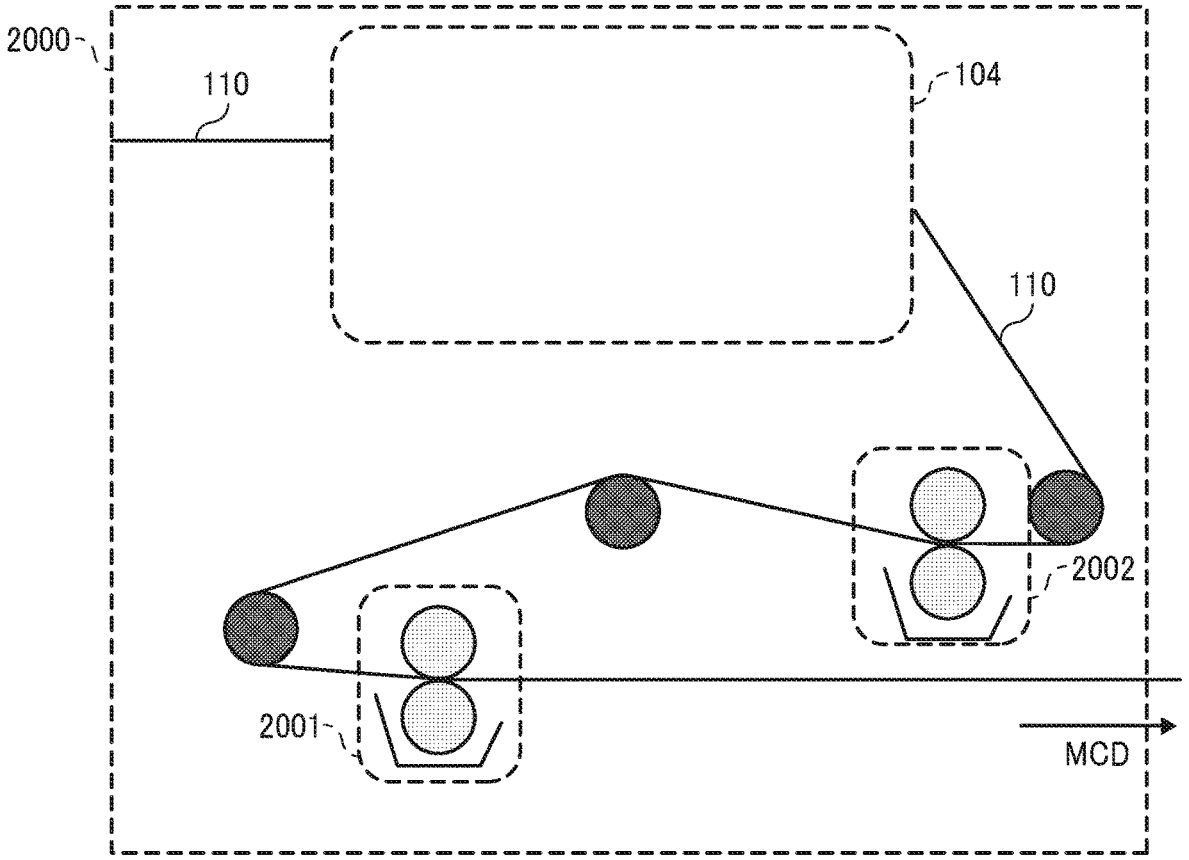
FIG. 10 is a schematic cross-sectional view of a treatment liquid applicator according to a fifth embodiment of the present disclosure.

FIG. 10 is a schematic cross-sectional view of the treatment liquid applicator 2000. The treatment liquid applicator 2000 of the present embodiment includes treatment liquid application units 2001 and 2002 serving as a liquid application unit for applying a treatment liquid to continuous sheet 110 and a dryer 104 for drying the continuous sheet 110 coated with the treatment liquid.

For example, the treatment liquid applicator 2000 may be disposed between the liquid applier 101 and the feeding roller 102 of the above-described printer to apply the treatment liquid to the continuous sheet 110 before printing.

The treatment liquid applicator 2000 may also be disposed between the liquid applier 101 and the winding roller 105 of the above-described printers to apply the treatment liquid to the continuous sheet 110 after printing.

As the treatment liquid, for example, there is a modifying material to modify a surface of the continuous sheet 110 by being applied to the surface of the continuous sheet 110. As a composition of the treatment liquid, for example, a solution to which cellulose that promotes penetration of moisture and a base material such as talc fine powder are added to surfactant may be used.

The cellulose includes, for example, hydroxypropyl cellulose. The surfactant includes, for example, any one of anionic, cationic, and nonionic surfactants, or a mixture of two or more of the foregoing surfactants. The treatment liquid may also contain fine particles.

In the present embodiment, two treatment liquid application units 2001 and 2002 are provided to apply treatment liquid to both sides of continuous sheet 110.

However, the treatment liquid applicator 2000 may include one treatment liquid application unit 2001 or 2002, or three or more treatment liquid application units. The configuration of the dryer 104 may be the same as the dryer 104 of one of the first, the second, and the third embodiment as described above. However, the dryer 104 of other configurations may be used.

The treatment liquid applicator 2000 of the present embodiment may also be applied to devices other than a printer.

In the present disclosure, the liquid to be applied to the medium is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling.

Specific examples of such liquids include, but are not limited to, solutions, suspensions, and emulsions containing solvents (e.g., water, organic solvents), colorants (e.g., dyes, pigments), functionality imparting materials (e.g., polymerizable compounds, resins, surfactants), biocompatible materials (e.g., DNA (deoxyribonucleic acid), amino acid, protein, calcium), and/or edible materials (e.g., natural colorants). Such liquids can be used as inkjet inks, surface treatment liquids, liquids for forming compositional elements of electric or luminous elements or electronic circuit resist patterns, and 3D modeling material liquids.

When a liquid discharge head is used as the liquid applicator, examples of an energy generation source discharging a liquid include an energy generation source using a piezoelectric actuator (a lamination-type piezoelectric element and a thin-film piezoelectric element), a thermal actuator using an electrothermal transducer element such as a heating resistor, a static actuator including a diaphragm plate and opposed electrodes, and the like.

The terms "image formation", "recording", "printing", "image printing", and "fabricating" used herein may be used synonymously with each other.

"The liquid discharge device" is an integrated unit including the head and a functional part(s) or unit(s), and is an assembly of parts relating to liquid discharge. For example, "the liquid discharge device" may be a combination of the head with at least one of a head tank, a carriage, a supply unit, a maintenance unit, and a main scan moving unit.

Herein, the terms "integrated" or "united" mean fixing the head and the functional parts (or mechanism) to each other by fastening, screwing, binding, or engaging and holding one of the head and the functional parts movably relative to the other. The head may be detachably attached to the functional part(s) or unit(s) each other.

For example, the head and a head tank are integrated as the liquid discharge device. The head and the head tank may be connected each other via, e.g., a tube to integrally form the liquid discharge device. Here, a unit including a filter may further be added to a portion between the head tank and the head.

The liquid discharge device may be an integrated unit in which a head is integrated with a carriage.

The liquid discharge device may be the head movably held by a guide that forms part of a main scan moving unit, so that the head and the main scan moving unit are integrated as a single unit. The liquid discharge device may include the head, the carriage, and the main scan moving unit that are integrated as a single unit.

In another example, the cap that forms part of the maintenance unit is secured to the carriage mounting the head so that the head, the carriage, and the maintenance unit are integrated as a single unit to form the liquid discharge device.

Further, the liquid discharge device may include tubes connected to the head mounted on the head tank or the channel member so that the head and the supply unit are integrated as a single unit. Liquid is supplied from a liquid reservoir source such as liquid cartridge to the head through the tube.

The main scan moving unit may be a guide only. The supply unit may be a tube(s) only or a mount part (loading unit) only.

The term "liquid discharge apparatus" used herein also represents an apparatus including the head or the liquid discharge device to discharge liquid by driving the head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, on which the liquid has been discharged.

The "liquid discharge apparatus" may be, for example, an image forming apparatus to form an image on a sheet by discharging ink, or a three-dimensional fabricating apparatus to discharge a fabrication liquid to a powder layer in which powder material is formed in layers, so as to form a three-dimensional fabrication object.

In addition, "the liquid discharge apparatus" is not limited to such an apparatus to form and visualize meaningful images, such as letters or figures, with discharged liquid. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate.

Examples of the "medium on which liquid can be adhered" include recording media, such as paper sheet, recording paper, recording sheet of paper, film, and cloth, electronic component, such as electronic substrate and piezoelectric element, and media, such as powder layer, organ model, and testing cell.

The "medium on which liquid can be adhered" includes any medium on which liquid is adhered, unless particularly limited.

Examples of "the material on which liquid can be adhered" include any materials on which liquid can be adhered even temporarily, such as paper, thread, fiber, fabric, leather, metal, plastic, glass, wood, and ceramic.

"The liquid discharge apparatus" may be an apparatus to relatively move a head and a medium on which liquid can be adhered. However, the liquid discharge apparatus is not limited to such an apparatus. For example, the liquid discharge apparatus may be a serial head apparatus that moves the head or a line head apparatus that does not move the head.

Examples of "the liquid discharge apparatus" further include a treatment liquid coating apparatus to discharge a treatment liquid to a sheet surface to coat the sheet surface with the treatment liquid to reform the sheet surface and an injection granulation apparatus to eject a composition liquid including a raw material dispersed in a solution from a nozzle to mold particles of the raw material.

The terms "image formation", "recording", "printing", "image printing", and "fabricating" used herein may be used synonymously with each other.

[Aspect A]

As illustrated in FIGS. 1 through 6, a dryer 104 for conveying and drying an object to be dried (continuous sheet 110), the dryer 104 includes a conveyor 103 including a first path (heating drum path Y3) and a second path (downstream path Y2) along which the object to be dried (continuous sheet 110) is conveyed, a conveyance direction of the second path (downstream path Y2) being different from a conveyance direction of the first path (heating drum path Y3), and a blower (supply and exhaust device 30) blows air onto the object to be dried (continuous sheet 110). The blower (supply and exhaust device 30) includes a first air outlet 31*a* that faces the first path (heating drum path Y3) and blows the air onto the object to be dried (continuous sheet 110) conveyed along the first path (heating drum path Y3), and a second air outlet 31*b* that faces the second path (downstream path Y2) and blows the air onto the object to be dried (continuous sheet 110) conveyed along the second path (downstream path Y2).

[Aspect B]

As illustrated in FIG. 3, the dryer 104 further comprises a heater (heating rollers 11A to 11E) including a first heating area "a" and a second heating area "b" to heat the object to be dried (continuous sheet 110), wherein the object to be dried (continuous sheet 110) is heated by the first heating area "a" of the heater (heating rollers 11A to 11E) while passing through the first path (heating drum path Y3). The object to be dried (continuous sheet 110) is heated by the second heating area "b" of the heater (heating rollers 11A to 11E) while passing through the second path (downstream path Y2), and the first heating area "a" and the second heating area "b" are located in different parts of the heater (heating rollers 11A to 11E).

[Aspect C]

As illustrated in FIGS. 2 and 3, each of the first heating area "a" and the second heating area "b" is a contact area between the heater (heating rollers 11A to 11E) and the object to be dried (continuous sheet 110).

[Aspect D]

As illustrated in FIG. 2, the dryer 104 further includes a plurality of heaters (heating rollers 11A to 11E) disposed along the conveyance direction of the object to be dried (continuous sheet 110), and the conveyor (heating drum 12) conveys the object to be dried (continuous sheet 110) to pass through the first heating area "a" of at least one heater of the plurality of heaters (heating rollers 11A to 11E) in the first path (heating drum path Y3). The conveyor 103 conveys the object to be dried to pass through the second heating area "b" of the at least one heater (heating rollers 11A to 11E), which the object to be dried (continuous sheet 110) contacts in the first path (heating drum path Y3), in the second path (downstream path Y2).

[Aspect E]

As illustrated in FIG. 4, the dryer 104 further includes a circular heater (heating drum 12) disposed on one of the first path (heating drum path Y3) and the second path (downstream path Y2), the circular heater (heating drum 12) including a curved contact area having a curvature smaller than a curvature of the contact area of one of the plurality of heaters (heating rollers 11A to 11E). The blower (supply and exhaust devices 30) blows air onto both of the object to be dried (continuous sheet 110) conveyed along the curved contact area of the circular heater (heating drum 12) disposed on one of the first path (heating drum path Y3) and the second path (downstream path Y2), and the object to be dried (continuous sheet 110) conveyed along another of the first path (heating drum path Y3) and the second path (downstream path Y2) on which the circular heater (heating drum 12) is not disposed.

[Aspect F]

As illustrated in FIG. 2, the plurality of heaters (heating rollers 11A to 11F) are arranged in an arc shape, and the first path (heating drum path Y3) includes an outer contact area of the plurality of heaters (heating rollers 11A to 11E) and the curved contact area of the circular heater (heating drum 12), and the second path (downstream path Y2) includes an inner contact area of the plurality of heaters (heating rollers 11A to 11E).

[Aspect G]

As illustrated in FIG. 6, the dryer 104 further includes a collector (collection duct 32 and exhaust device 37) to collect the air removed from a vicinity of the object to be dried (continuous sheet 110) conveyed through the first path (heating drum path Y3) and the second path (downstream path Y2) by the air blown from the blower (supply and exhaust devices 30). The collector (collection duct 32 and exhaust device 37) includes a first collection port 32*a* facing the first path (heating drum path Y3) and a second collection port 32*b* facing the second path (downstream path Y2) from which the air removed from the vicinity of the object to be dried (continuous sheet 110) is collected.

[Aspect H]

The collector (collection duct 32 and exhaust device 37) condensing the air collected by the collector (collection duct 32 and exhaust device 37) to collects a liquid component in the air.

[Aspect I]

As illustrated in FIG. 6, the dryer 104 further includes a controller 40 to control a temperature of the air blown from the blower (supply and exhaust devices 30) to be equal to or above a boiling point of a liquid component contained in the object to be dried (continuous sheet 110).

[Aspect J]

As illustrated in FIGS. 1 and 9, a printer (1000, 1010) includes a liquid applier 101 to apply a liquid to the object to be dried (continuous sheet 110) and the dryer 104 as described above

[Aspect K]

As illustrated in FIGS. 6 and 7, a dryer 104 for conveying and drying an object to be dried (continuous sheet 110), the dryer 104 includes a conveyor 103 including a first path (heating drum path Y3) and a second path (downstream path Y2) along which the object to be dried (continuous sheet 110) is conveyed, the first path (upstream path Y1, heating drum path Y3) facing the second path (downstream path Y2), and a blower (supply and exhaust devices 30) to blow air onto the object to be dried. The blower (supply and exhaust devices 30) includes a first air outlet 31*a* that faces the first path (upstream path Y1, heating drum path Y3) and blows the air onto the object to be dried (continuous sheet 110) conveyed along the first path (upstream path Y1, heating drum path Y3), and a second air outlet 31*b* that faces the second path (downstream path Y2) and blows the air onto the object to be dried (continuous sheet 110) conveyed along the second path (downstream path Y2).

[Aspect L]

As illustrated in FIGS. 1 through 9, a liquid applicator (first printer 1001, second printer 1002) for applying a liquid onto an object to be dried (continuous sheet 110), the liquid applicator (first printer 1001, second printer 1002) includes a liquid applier 101 to apply the liquid onto the object to be dried (continuous sheet 110), and a dryer 104 to convey and dry the object to be dried (continuous sheet 110) to which the liquid is applied by the liquid applier 101.

The dryer 104 includes a conveyor 103 including a first path (heating drum path Y3) and a second path (downstream path Y2) along which the object to be dried (continuous sheet 110) is conveyed, the first path (heating drum path Y3) facing the second path (downstream path Y2), and a blower (supply and exhaust devices 30) to blow air onto the object to be dried.

The blower (supply and exhaust devices 30) includes a first air outlet 31*a* that faces the first path (heating drum path Y3) and blows the air onto the object to be dried (continuous sheet 110) conveyed along the first path (heating drum path Y3), and a second air outlet 31*b* that faces the second path (downstream path Y2) and blows the air onto the object to be dried (continuous sheet 110) conveyed along the second path (downstream path Y2).

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A dryer for drying printed media, the dryer comprising:

rollers configured to convey the printed media, the rollers including a heating drum configured to contact a back surface of the printed media and to convey the print media along a curved conveyance path that changes a direction of the printed media from a first conveyance path to a second conveyance path; and an exhaust device disposed between the curved conveyance path and the second conveyance path, the exhaust device facing a front surface of the printed media in the second conveyance path and a back surface of the printed media in the first conveyance path, wherein the front surface of the printed media includes an applied liquid, wherein the exhaust device includes:

a first collection port facing the front surface of the printed media in the curved conveyance path and configured to collect air from the front surface in the curved conveyance path;

a second collection port facing the front surface of the printed media in the second conveyance path and configured to collect air from the front surface in the second conveyance path, and an air outlet configured to blow air to the front surface of the printed media in the second conveyance path, wherein the second collection port and the air outlet are disposed at a same surface of the exhaust device facing the front surface of the printed media in the second conveyance path.

2. The dryer according to claim 1, wherein:

the exhaust device includes a plurality of first collection ports disposed along the curved conveyance path.

3. The dryer according to claim 2, wherein:

the plurality of first collection ports are arranged on a side surface of the exhaust device, and the side surface is inclined to the curved conveyance path.

4. The dryer according to claim 2, wherein:

the exhaust device includes a plurality of second collection ports disposed along the second conveyance path.

5. The dryer according to claim 1, wherein:

the second collection port is disposed downstream from the air outlet in a direction of conveyance of the object of the second conveyance path.

6. The dryer according to claim 1, wherein:

the exhaust device includes a plurality of second collection ports disposed along the second conveyance path and one or more air outlets disposed along the second conveyance path, and a number of the second collection ports is larger than a number of air outlets.

7. The dryer according to claim 1, wherein the exhaust device includes:

a first collection duct to collect the air collected from the first collection port; and a second collection duct to collect the air collected from the second collection port.

8. The dryer according to claim 1, wherein the exhaust device includes:

a first heating roller configured to contact and heat the printed media conveyed along the first conveyance path, and a second heating roller configured to contact and heat the printed media conveyed along the second conveyance path.

9. The dryer conveyor according to claim 1, wherein:

the first collection port is disposed on a first side surface of the exhaust device, and the second collection port is disposed on a second side surface of the exhaust device.

10. The dryer according to claim 1, wherein:

a direction of conveyance of the printed media conveyed along the first conveyance path is different from a direction of conveyance of the printed media conveyed along the second conveyance path.

11. The dryer according to claim 1, wherein:

the first conveyance path defines a path formed by the printed media wound around a plurality of heating rollers.

12. The dryer according to claim 1, further comprising:

a heat element configured to transfer heat into the air blown from the air outlet.

13. The dryer according to claim 1, further comprising:

a plurality of heating rollers arranged around the heating drum; and a plurality of the exhaust devices disposed between the heating drum and the plurality of heating rollers, wherein a diameter of the heating drum is larger than a diameter of each of the plurality of heating rollers.

14. A printing apparatus comprising:

the dryer according to claim 1; and a liquid applicator to apply liquid onto the printed media.

* * * * *